US011583103B2

(12) United States Patent
Shane et al.

(10) Patent No.: US 11,583,103 B2
(45) Date of Patent: Feb. 21, 2023

(54) INFANT SOOTHING DEVICE AND METHOD

(71) Applicant: Richard Shane, Menlo Park, CA (US)

(72) Inventors: Richard Shane, Menlo Park, CA (US); Chris Tacklind, Palo Alto, CA (US)

(73) Assignee: Richard Shane, Menlo Park, CA (US)

( * ) Notice: Subject to any disclaimer, the term of this patent is extended or adjusted under 35 U.S.C. 154(b) by 0 days.

(21) Appl. No.: 17/498,663

(22) Filed: Oct. 11, 2021

(65) Prior Publication Data

US 2022/0022664 A1 Jan. 27, 2022

Related U.S. Application Data

(60) Continuation of application No. 15/855,718, filed on Dec. 27, 2017, now Pat. No. 11,141,002, which is a continuation of application No. 14/331,011, filed on Jul. 14, 2014, now Pat. No. 9,883,752, which is a continuation of application No. 12/390,866, filed on Feb. 23, 2009, now Pat. No. 8,776,285, which is a division of application No. 11/447,498, filed on Jun. 5, 2006, now Pat. No. 8,782,827.

(51) Int. Cl.
*A47D 9/02* (2006.01)
*A47D 13/10* (2006.01)

(52) U.S. Cl.
CPC ..... *A47D 9/02* (2013.01); *A47D 13/10* (2013.01); *A47D 13/107* (2013.01)

(58) Field of Classification Search
CPC ..... A47D 13/02; A47D 13/025; A47D 13/10; A47D 13/105; A47D 13/107; A47D 9/02
USPC ..... 5/93.1, 93.2, 94, 95, 96, 97, 98.1, 98.3, 5/100, 101, 102, 103, 104, 105, 106, 107, 5/108, 109, 99.1
See application file for complete search history.

(56) References Cited

U.S. PATENT DOCUMENTS 2,765,478 A * 10/1956 Pinto ..... A47D 9/04 5/104
2,810,428 A * 10/1957 Plese ..... A47D 13/107 297/487
2,855,023 A * 10/1958 Mekeel ..... A47D 13/107 248/592
2,869,145 A 1/1959 Gregory
2,916,745 A * 12/1959 Lesk ..... A47D 9/04 601/60
3,004,793 A * 10/1961 Loomis ..... A47D 11/005 297/274
3,031,686 A * 5/1962 Muzzey ..... A47D 9/04 5/904
3,462,113 A * 8/1969 Macleod ..... A63G 11/00 248/575

(Continued)

FOREIGN PATENT DOCUMENTS

DE 202005017014 U1 1/2006
KR 102039856 B1 11/2019

*Primary Examiner* — Michael Safavi
(74) *Attorney, Agent, or Firm* — Manatt, Phelps & Phillips, LLP

(57) ABSTRACT

A novel and improved device to assuage distressed infants by means of adjustable vertical motion combined with adjustable orientation. The motion is adjustable in terms of amplitude, frequency and time. The device allows the infants to be held face-inward or face-outward in the case of vertical orientation and prone or supine in the case of horizontal orientation.

8 Claims, 3 Drawing Sheets

(56) References Cited

U.S. PATENT DOCUMENTS 3,653,080 A * 4/1972 Hafele ..... A47D 13/025 D6/333
3,934,283 A 1/1976 Raffel
3,952,343 A 4/1976 Wong
3,955,222 A 5/1976 Pater
3,992,731 A 11/1976 Carswell
3,993,042 A 11/1976 Gatts
4,028,753 A * 6/1977 Rios ..... B60N 2/2854 5/108
4,048,684 A 9/1977 Korner et al.
4,071,916 A 2/1978 Nelson
4,081,869 A * 4/1978 Ash ..... A47D 13/107 297/274
4,084,273 A * 4/1978 Haynes ..... A47D 13/102 5/108
4,091,563 A * 5/1978 Noble ..... A63H 13/06 446/334
4,152,795 A 5/1979 Rodosta et al.
4,175,550 A 11/1979 Leininger et al.
4,187,568 A 2/1980 McMullan et al.
4,188,678 A * 2/1980 Rawolle ..... A47D 13/107 297/274
4,211,401 A * 7/1980 Cunard ..... A47D 13/105 5/109
4,226,467 A * 10/1980 Boudreau ..... A47D 13/107 472/110
4,256,095 A 3/1981 Graham
4,258,446 A * 3/1981 McAllister ..... A47D 9/02 5/105
4,328,598 A 5/1982 Evanson
4,344,422 A 8/1982 Immel
4,346,486 A 8/1982 Keller
4,371,206 A * 2/1983 Johnson, Jr. ..... A47D 13/102 5/101
4,392,261 A 7/1983 Ivory et al.
4,412,533 A 11/1983 Callahan
4,419,777 A 12/1983 Parker
4,430,992 A 2/1984 Christ
4,483,327 A 11/1984 Graham et al.
4,490,867 A 1/1985 Gabrielsson
4,494,260 A 1/1985 Olds et al.
4,553,786 A 11/1985 Lockett et al.
4,578,833 A 4/1986 Vrzalik
4,586,492 A 5/1986 Manahan
4,590,631 A 5/1986 Varney
4,598,946 A * 7/1986 Cone ..... A47D 13/107 5/105
4,620,334 A 11/1986 Robinson
4,625,487 A 12/1986 Blakeway
4,656,680 A 4/1987 Wilson
4,667,358 A 5/1987 Penterman
4,672,952 A 6/1987 Vrzalik
4,681,096 A 7/1987 Cuervo
4,730,606 A 3/1988 Leininger
4,752,980 A 6/1988 Nafte
4,775,184 A 10/1988 Larkin
4,785,678 A * 11/1988 McGugan ..... A47D 13/105 248/370
4,785,797 A * 11/1988 Cuervo ..... A61H 23/0263 601/60
4,793,010 A * 12/1988 Gross ..... A47D 9/04 5/904
4,809,373 A 3/1989 Murray
4,837,876 A 6/1989 Levy
4,856,128 A 8/1989 Alsip et al.
4,856,130 A 8/1989 Berkovich
4,881,285 A 11/1989 Zeeb
D305,584 S * 1/1990 Spilman ..... D6/334
4,891,852 A * 1/1990 Lopez, Jr. ..... A47D 9/02 5/107
4,893,366 A 1/1990 Rosen
4,911,499 A 3/1990 Meeker
4,941,709 A 7/1990 Moller
4,944,054 A 7/1990 Bossert
4,947,832 A 8/1990 Blitzer
4,951,331 A 8/1990 Pereira
4,970,740 A * 11/1990 Crawford ..... A47D 9/02 5/103
4,985,949 A 1/1991 Jantz
4,987,624 A 1/1991 Nafti
5,003,651 A 4/1991 Rosen
5,016,301 A * 5/1991 Combs ..... A47D 7/002 5/101
5,020,170 A 6/1991 Ruf
5,042,097 A 8/1991 Fuchs
5,048,135 A 9/1991 Chen
5,081,722 A 1/1992 Yu
5,088,138 A 2/1992 Munster
5,099,528 A 3/1992 Wadman
5,107,555 A 4/1992 Thrasher
5,139,462 A 8/1992 Gabe
5,183,457 A 2/1993 Gatts et al.
5,228,155 A 7/1993 Shultz et al.
5,230,523 A * 7/1993 Wilhelm ..... B62B 7/12 280/87.051
5,249,640 A 10/1993 Grove
5,303,433 A 4/1994 Jang
5,342,113 A 8/1994 Wu
5,368,361 A 11/1994 Wen-Ming
5,376,053 A * 12/1994 Ponder ..... A47D 13/105 472/32
5,381,572 A 1/1995 Park
5,398,353 A * 3/1995 Sachathamakul ..... A47D 9/02 5/105
5,411,315 A 5/1995 Greenwood
5,415,454 A * 5/1995 Fu-Tsung ..... A47D 1/006 297/130
5,451,095 A 9/1995 Riback
5,553,337 A 9/1996 Lin
5,572,903 A 11/1996 Lee
5,574,339 A 11/1996 Kattwinkel et al.
5,588,164 A 12/1996 Proulx
5,615,428 A * 4/1997 Li ..... A47D 9/02 5/104
5,618,262 A 4/1997 Rene
5,660,430 A 4/1997 Clarke
5,686,884 A 11/1997 Larkin et al.
5,694,655 A * 12/1997 Shepler ..... A47D 9/02 5/101
5,711,045 A * 1/1998 Caster ..... A47D 9/02 5/108
5,735,575 A 4/1998 Harza
5,803,817 A * 9/1998 Stern ..... A47D 1/10 472/118
5,806,113 A * 9/1998 McMahan ..... A47D 9/04 5/93.1
5,845,350 A 12/1998 Beemiller et al.
5,863,097 A * 1/1999 Harper ..... A47D 13/107 297/260.2
5,887,945 A 3/1999 Sedlak
5,940,914 A 8/1999 Robbins
5,941,599 A * 8/1999 Roberts ..... A47C 27/086 297/181
5,956,786 A * 9/1999 Huang ..... A47D 9/02 403/329
6,026,524 A * 2/2000 Barger ..... A47D 9/02 5/107
6,052,852 A * 4/2000 Huang ..... A47C 31/003 5/733
6,068,566 A 5/2000 Kim
6,152,081 A * 11/2000 Baker ..... A01K 1/034 119/504
6,158,067 A * 12/2000 Cheng ..... A47D 9/02 5/99.1
6,263,526 B1 7/2001 Tu
6,341,394 B1 * 1/2002 Wang ..... A47D 9/02 5/99.1
6,378,940 B1 * 4/2002 Longoria ..... A47D 13/107 297/DIG. 11
6,386,986 B1 5/2002 Sonner et al.
6,431,646 B1 8/2002 Longoria

(56) References Cited

U.S. PATENT DOCUMENTS 6,457,438 B1 * 10/2002 Baker ..... A01K 1/034 119/504
6,470,516 B2 10/2002 Lopez, Jr.
6,482,066 B1 11/2002 Kelly
6,505,361 B1 1/2003 Ogawa
6,519,792 B2 2/2003 Chen
6,571,408 B1 6/2003 Wang
6,574,806 B1 * 6/2003 Maher ..... A47D 13/107 297/260.2
6,588,527 B2 7/2003 Lerner et al.
6,594,840 B2 7/2003 Tomas et al.
6,625,852 B1 9/2003 Hanson
6,629,727 B2 * 10/2003 Asbach ..... B60N 2/2821 297/188.21
6,704,949 B2 3/2004 Waldman et al.
6,705,950 B2 3/2004 Wood et al.
6,728,980 B1 5/2004 Chen
6,774,589 B2 8/2004 Sato et al.
6,811,217 B2 11/2004 Kane et al.
6,814,670 B2 11/2004 Morita et al.
6,851,144 B2 2/2005 Wang
6,854,138 B2 2/2005 Xu
6,884,226 B2 4/2005 Pereira
6,908,397 B2 6/2005 Armbruster et al.
6,908,398 B1 6/2005 Kang
6,916,249 B2 7/2005 Meade
6,966,082 B2 11/2005 Kenneth et al.
6,971,127 B2 12/2005 Richard
7,070,188 B2 7/2006 Waldman
7,100,724 B2 9/2006 Haigh
7,111,346 B2 9/2006 Inman et al.
7,159,254 B1 1/2007 Voorting
7,228,576 B2 6/2007 Inman et al.
7,381,138 B2 6/2008 Dillner et al.
7,563,170 B2 * 7/2009 Bellows ..... A47D 13/10 472/29
7,824,273 B2 * 11/2010 Clapper ..... A63G 13/08 472/95
8,776,285 B2 7/2014 Shane et al.
8,782,827 B2 7/2014 Shane et al.
9,433,304 B2 * 9/2016 Mountz ..... A47D 13/105
9,883,752 B2 2/2018 Shane et al.
11,141,002 B2 10/2021 Shane et al.
2002/0113469 A1 * 8/2002 Stern ..... A47D 13/10 297/256.16
2004/0060117 A1 * 4/2004 Chan ..... A47D 13/08 5/655
2004/0077287 A1 * 4/2004 Odiwo ..... A61M 21/00 446/491
2004/0261180 A1 * 12/2004 Birns ..... A47D 15/008 5/655
2005/0054486 A1 * 3/2005 Turner ..... A47D 13/107 482/28
2005/0091743 A1 * 5/2005 Bloemer ..... A47D 9/02 5/105
2005/0176340 A1 * 8/2005 Gubitosi ..... A47D 13/105 446/227
2005/0225137 A1 * 10/2005 Mead ..... A47D 15/006 297/250.1
2005/0264088 A1 * 12/2005 Tadin ..... A47D 13/107 297/488
2005/0283908 A1 * 12/2005 Wong ..... A47D 9/02 5/105
2006/0270480 A1 * 11/2006 Chen ..... A47D 13/105 472/118
2007/0007804 A1 * 1/2007 Pemberton ..... A47D 13/10 297/260.2
2009/0181780 A1 * 7/2009 Myers ..... A47D 13/107 297/283.1

* cited by examiner

INFANT SOOTHING DEVICE AND METHOD

PRIORITY CLAIMS/RELATED APPLICATIONS

This application is a continuation and claims priority under 35 USC 120 to U.S. patent application Ser. No. 15/855,718 filed Dec. 27, 2017 that is a continuation and claims priority under 35 USC 120 to U.S. patent application Ser. No. 14/331,011 filed Jul. 14, 2014 (now issued U.S. Pat. No. 9,883,752 on Feb. 6, 2018) that is a continuation and claims priority under 35 USC 120 to U.S. patent application Ser. No. 12/390,866 filed on Feb. 23, 2009 entitled "Infant Soothing Device and Method" which is in turn a divisional application of and claims priority under 35 USC 120 and 35 USC 121 to U.S. patent application Ser. No. 11/447,498 filed on Jun. 5, 2006 and entitled "Baby Soothing Device and Method", all of which are incorporated by reference herein.

FIELD OF THE INVENTION

The invention relates generally to a device and method for soothing an infant.

BACKGROUND OF THE INVENTION

Crying babies are the source of great frustration for adults, particularly for their parents. Because they cannot speak, infants cry as their primary means of communication and they do it with great frequency. Babies cry as a means to communicate that they are in pain, unhappy, tired, hungry or generally in need of attention. Sometimes babies cry to block external stimuli in an attempt to calm down. Regardless of the reason, crying is disturbing and gets the attention of those within earshot.

Caregivers are adept at developing strategies for soothing crying babies. These generally involve holding the infant firmly in the arms and bouncing or rocking. Babies train caregivers to hold them in their preferred orientations and angles as well as to move them in their preferred motion. Commonly the only soothing position for babies is to be held vertically against the chest. Often the time required to soothe is long and difficult, straining the caregiver to exhaustion.

There are known devices that attempt to soothe an infant but they have limitations and drawbacks. For example, there is a static device which only positions babies in an inclined position without enabling movement of the device. However, the movement is key to assuaging babies. Moreover, restricting the orientation to an inclined angle of 30 or 45 degrees is limiting in terms of the variety of babies who can be soothed. Another conventional device is similar in that it does not move. In addition, the inclined angle does not adjust. Moreover, the device is designed for a "face out" positioning only. This positioning does not effectively soothe the population of babies that require a "face in" position. Other devices provide a dismountable and adjustable fastening device for laying down pediatric patients in an inclined position, but are also static devices which means the beneficial effects of motion are not available to babies who are put into them. They are designed to help babies who suffer from illnesses where the effects of gravity contribute to making them feel better (e.g. gastroesophageal reflux), but they do not address the issue of calming babies who are crying for other reasons. Finally, the angle of the devices is not adjustable.

Thus, it is desirable to provide an infant soothing device that overcomes the limitations of the conventional devices and it is to this end that the present invention is directed.

SUMMARY OF THE INVENTION

A device and method are provided that assuage distressed babies. The device holds an infant in an orientation that can be adjusted from horizontal to vertical, depending on the "comfort requirements" of the infant. The device also moves the infant in a vertical motion with adjustable amplitude, frequency and duration. While generally useful in calming distressed babies, this device has particular value to babies that are sick with a variety of illnesses or problems where incessant crying is detrimental (e.g. lung disease as consequence of premature birth or eye problems where increased stress worsens the problems). Additional illnesses where this device has particular value are those related to "failure to thrive" and gastroesophageal reflux. Lastly, the device has a beneficial effect on infants suffering from colic. This illness is characterized by episodes during which an infant is irritable, cries or screams excessively and draws up the legs. Colicky babies tend to be worse in the evenings and do not respond to the usual means of comforting, such as feeding, cuddling, or diaper changing.

The invention provides a novel and improved device to safely hold babies while moving the infant with a vertical motion. The device enables babies to calm themselves through the motion, the orientation and the angle of the device. The device permits the placement of babies in an adjustable orientation that allows them to be placed horizontally, vertically or any orientation between. The device also permits the adjustment of the motion of the device based on the infant's weight. Additionally, the device permits the infant to face inward or outward.

In one embodiment, the device moves the infant in a vertical motion with adjustable amplitude, frequency and duration. The device enables babies to be placed prone or supine (face in or face out in the vertical orientation). The device unburdens caregivers from having to hold babies for excessive periods while they are crying. The device also allows babies to sleep while being held in the device.

The device may have an easily cleaned surface against which the babies rest to enable easy care and maintenance of the device. The device also facilitates the fast and easy installation or removal of babies without permitting the babies to release themselves. The device preferably holds babies against a surface which simulates the human form. The device preferably is readily configurable for use with different sizes and types of cribs, tables, chairs or other pieces of furniture as well as walls. The device also safely and securely holds babies against the surface of the device by means of compliant holder that is both comfortable and secure.

In an embodiment of the invention, the device utilizes springs to assist the motion generated by the motor, thereby reducing the power requirements of the motor. In other embodiments of the invention, different types of devices are used to enable the motion of the invention, such as air bellows, pneumatic pumps, hydraulic or magnetic devices and the like. The device may also provide a smooth transition from a vertical orientation to a horizontal orientation to allow assuaged babies that have fallen asleep in the device to sleep in the typical horizontal orientation without removal.

DETAILED DESCRIPTION OF A PREFERRED EMBODIMENT

Figure 1:
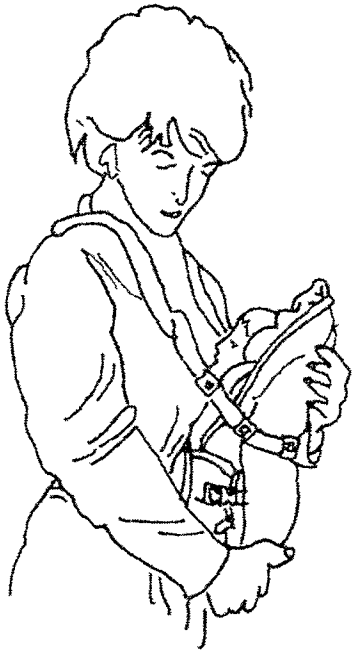
FIG. 1 shows a caregiver holding an infant.

FIG. 1 shows the common sight of a caregiver holding an infant. In this depiction, the child is held in a face-in orientation as the caregiver gently bounces the child up and down. This motion will be quite tiring for the caregiver if needed for long periods. To reduce arm strain, products such as the Baby Bjorn® or other "frontpacks" may be used to hold the infant. However, products of this type tend to strain the back of the caregiver. To facilitate bouncing motions, a caregiver may sit on a large inflated ball. This activity requires balance and caution as the ball is liable to roll causing the caregiver and child to fall. This vertical position coupled with vertical motion is often the only way to calm a crying infant. The invention provides a device that holds the infant in one or more orientations and vertically moves the infant to soothe the infant without the caregiver having to hold and bounce the infant.

Figure 2:
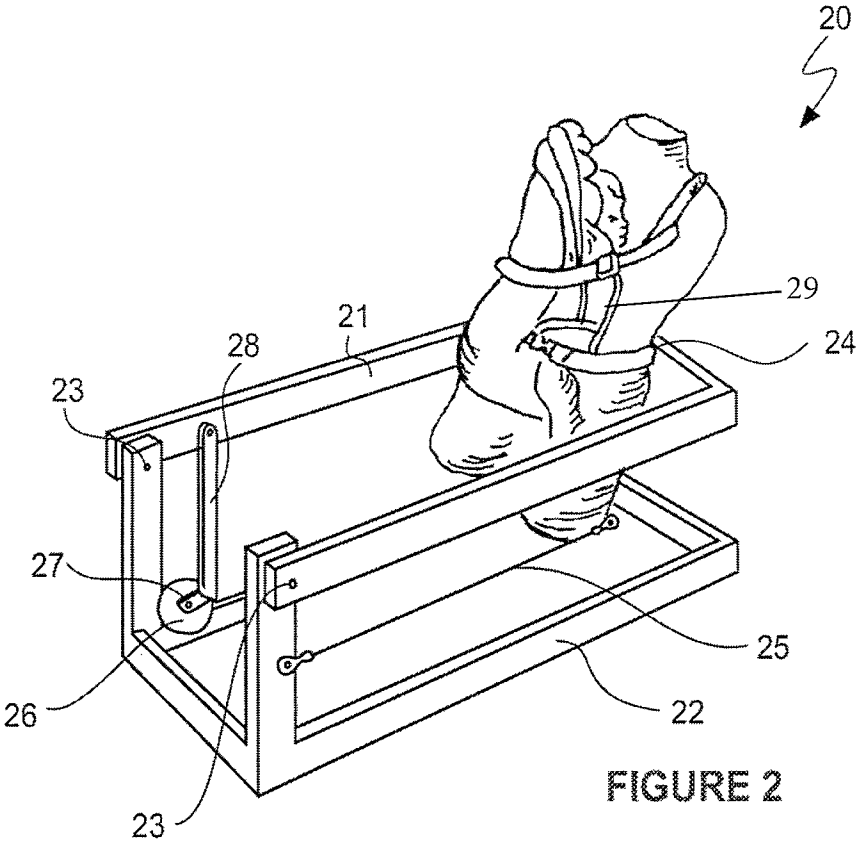
FIG. 2 is an embodiment of an infant soothing device with a motor drive.

FIG. 2 shows one embodiment of an infant soothing device in accordance with the invention. The device has an infant resting member 20 that is fitted to an upper frame 21. In the preferred embodiment, the infant resting member is shaped like a human torso. The upper frame 21 is pivotally attached to a lower frame 22 through a pivot 23. The torso 20 is pivoted on the upper frame 21 by a hinge 24 to adjust the angle of the torso (and therefore the infant) relative to the upper frame 21 and the torso 20 is maintained at the angle by a parallel member 25. When an infant is secured to the torso, the upper frame or torso may be directly pushed up and down resulting in a vertical motion of the infant. The device optionally may include a counter weight or counter spring. The vertical motion is easier if such a counter weight or counter spring is provided. The driving force for the bouncing may be provided directly by the care giver which greatly reduces the strain on the caregiver or it may be provided by an automated mechanism.

In a preferred embodiment, an actuator 26 is fitted to the lower frame 22. A crank 27 connects the actuator to the upper frame 21 through a link 28. A constant rotational motion of the actuator results in a roughly sinusoidal angular motion of the upper frame 21. This results in a roughly sinusoidal vertical motion of the torso. The actuator may be a DC motor, an AC motor, a wind-up mechanism, falling weight, or other mechanisms to impart a sinusoidal vertical motion as will be clear to one skilled in the art. Thus, in this preferred embodiment, an approximation of the vertical position and vertical bouncing motion of a caregiver are achieved.

In a preferred embodiment, the torso is a female form although the infant resting member may have a variety of different forms that are within the scope of the invention. For example, the infant resting member may not resemble a torso in appearance since other shapes may be selected to hold the infant firmly. The infant resting member may also be transformable from one shape to another. For example, inflatable structures may be particularly well suited for some embodiments. The inflatable elements may be used to support parts of the infant such as, but not limited to, a neck support, arm supports and leg supports. Inflatable elements may be deployed to retain the infant with a gentle clamping action. Inflation and deflation of large elements may be used to effect a change in angle of the infant resting member.

The infant resting member is preferably made of compliant materials to simulate a mother's skin softness, texture and temperature. It will be beneficial to make the surface of the infant resting member easily cleanable or replaceable or provide a removable cover for the infant resting member. The replacement "skins" or removable cover may have different properties that may include but are not limited to a range of softness, different skin colors, skin textures, body shape, and gender. The infant resting member may also have an adjustable shape wherein the shape can be adjusted by any inflation mechanisms or other mechanisms/methods known to those skilled in the art.

The infant resting member 20 optionally may include a heating element/device on or under the surface of the infant resting member. The heating element may be a hot water mechanism or an electrical mechanism as will be clear to one skilled in the art that maintains the portion of the infant resting surface on which the infant rests at a particular temperature, such as the typical body temperature of the mother of the infant. In a preferred embodiment, a newborn temperature monitor may be used to control the temperature of the heating element.

Many caregivers use an over the shoulder infant carrier as in FIG. 1. This same carrier may be attached to the infant resting member 20 as shown in FIG. 2 wherein the carrier may be fitted to support the infant oriented facing the infant resting member or away from the infant resting member. The device or the carrier used with the device may include a safety mechanism to facilitate placing the infant into the carrier and removing the infant. For example, the safety mechanism may securely attach the carrier to the device by, for example, ensuring that the carrier does not slide off the shoulders of the infant resting member when the infant resting member is the torso shape shown in FIG. 2. The safety mechanism may also include a mechanism to hold the infant carrier down while removing the infant from the device wherein the mechanism may include hooks, buttons, hook and loop fasteners, or other devices/mechanisms as would be known to those skilled in the art. The safety mechanism may further include features that permit the infant to spend extended time in the device without discomfort. For example, the features may include a saddle like features to support the infant's bottom, stirrups to support the legs or feet or a member that becomes blanket-like when the infant is removed.

The angle of the infant resting member 20 (and therefore the infant resting on the infant resting member) relative to the upper frame 21 and also relative to an angle perpendicular to the ground may be adjustable. The angle is adjusted by adjusting the length of parallel member 25. Alternatively, inflatable structures may be used to set the angle. The device may further include additional hinge means as will be obvious to one skilled in the art. The device may also include a mechanism that allows continuous motion transitioning the infant from vertical to horizontal in a smooth motion to a new angle. Thus, once the infant is calmed, the angle may be adjusted all the way to a horizontal sleeping position.

Other embodiments of the device may employ sliding mechanisms for the vertical motion. Sliding mechanisms may be more compact and more suitable for other mounting mechanisms. For example, the sliding mechanism may be mounted to the end of a standard crib and mounting mechanisms may be provided for a wide variety of crib sizes and types as well as other objects such as changing tables, walls, tables, chairs and the like. Mounting means may include but are not limited to clamps, hooks, and straps. A free standing embodiment of the device may include wheels for easy transport within the home or in a hospital ward. A wide range of amplitudes may be accommodated by sliding vertical configurations. The sliding range could span from close the floor, minimizing tipping, to a standing position which may be more convenient for the care giver.

In FIG. 2, an exemplary type of oscillatory motion is provided by a motor 26, the crank 27 and the link 28. The frequency of the oscillatory motion is readily controlled by the speed of the motor. The amplitude of the motion is readily adjusted by adjusting the length of the crank 27. Alternatively, the amplitude may also be adjusted by changing the position of the attachment of the link 28 to the upper frame 21. As stated earlier, the motion of the device in FIG. 2 is roughly sinusoidal, although selection of the exact lengths of the components will modify the motion profile. As an alternative, a cam (not shown) may be used to replace the crank and link to provide a wide variety of motions of a fixed character and then the cam could be replaced to change the character and magnitude of the motion. As another alternative, an adjustable follower could change the amplitude and select from a few different profiles using a single cam assembly.

In the embodiment shown in FIG. 2, the motor 26 may be a DC servo type motor that may be programmed to produce any torque profile desired within the limits of the motor chosen. To closely match the actual motion of the caregiver when the caregiver is holding and bouncing the infant, a small recording accelerometer is attached to the caregiver in order to capture the precise motion of the caregiver while performing the soothing bouncing motion. Then, this motion can be reproduced by the DC servo motor. In accordance with the invention, even vibrations and stuttering motions of the caregiver may be replicated by a servo motor or using a separate vibration motor.

The device may include a counterbalance weight or a spring (not shown) to reduce the torque ripple demanded by the motor which will reduce the size and power dissipation of the motor greatly. A spring may also be used to make the moving body oscillate with a resonant frequency. The resonant frequency for a particular geometry is determined by the mass of the infant and the spring constant of the spring. Changing the spring constant or changing the geometry will yield a wide range of resonant frequencies.

Figure 3:
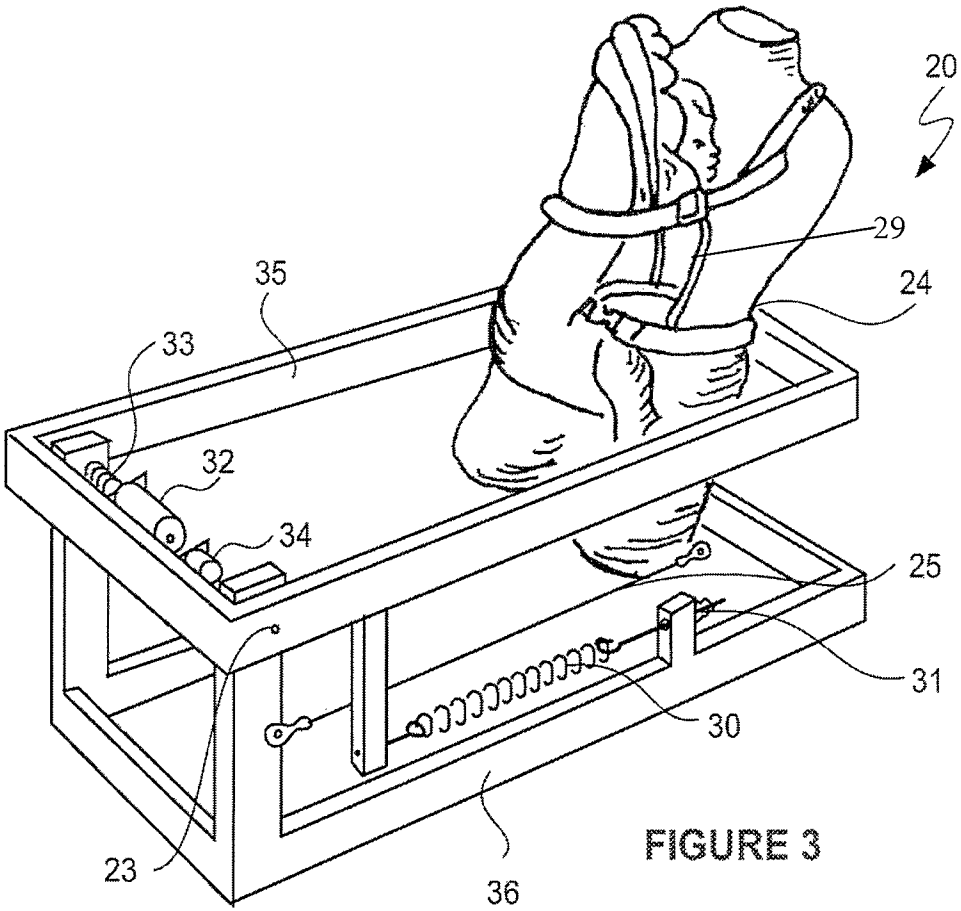
FIG. 3 is an embodiment of an infant soothing device with a resonant drive.

FIG. 3 illustrates a preferred embodiment of the device. This device has the same infant resting member 20 and the parallel member 25 arranged to provide vertical motion. While similar in function to the upper frame 21 and the lower frame 22 in FIG. 2, this device has an upper frame 35 and a lower frame 36 with a slightly different design. In particular, the device may include a sizeable spring 30 to support the weight of the infant wherein the spring 30 is connected to the upper frame 35 as shown. The extension of the spring may be adjusted by a knob 31 to set the average position of the upper frame 35. The knob position or spring position may be labeled accordingly as a weight setting for the infant. This configuration provides a resonant vertical motion. The resonant frequency is determined by the mass of the infant, the spring constant and geometry wherein the frequency may be adjusted by altering the geometry or changing the spring. A locking mechanism may be included to fix the mechanism in a rigid state.

The device in FIG. 3 may include a small motor and gear box 32 mounted to the upper frame 35. The output shaft is coupled to the lower frame 36 by a compliant member 33. If the motor is run with alternating direction at the resonant frequency of the spring mass system, then the vertical motion will quickly increase to mechanical limits. The power required to achieve large excursions is substantially less than for a crank or cam system.

A shaft encoder 34 may be provided which can detect the angle between the upper frame 35 and lower frame 36. The encoder 34 may be a potentiometer or an absolute or incremental digital encoder. Alternatively, back electro motive force (EMF) from the motor may be readily sensed and used as the encoder. A micro controller is ideally suited to monitor an encoder, control the motor and provide an interface to the user. The encoder may be used to set the limits of motion of the vertical motion. In the case of a potentiometer (or an absolute digital encoder), the readings at each end of travel may be recorded. For an incremental encoder, the software will need to infer the stop positions from a first "crash" against the end stops. The encoder may also be used to establish the resonant drive required. This may be as simple as differentiating the position and driving the motor in the direction of motion. The amplitude of the motion is readily monitored by looking at the angular travel of the encoder. Under software control, the magnitude of the oscillation may be limited to suit the user. Timing functions are also readily handled by the micro controller. In the device in FIG. 3, the resonant frequency is fixed so that the micro controller cannot change the frequency through control of the small motor. A manual or motorized mechanism for adjusting the spring geometry may be used to add frequency control for the device.

In accordance with the invention, the device may include a printed circuit board with an appropriate micro controller, motor drive chips, display and user interface buttons. Furthermore, additional features may be readily included. These features may include but are not limited to a timer functions, sound activation, sound output and connection to other devices. The timing functions may include a count down timer, delayed start timer, a repeating interval timer, and other features clear to one skilled in the art.

While the foregoing has been with reference to particular embodiments of the invention, it will be appreciated by those skilled in the art that changes in these embodiments may be made without departing from the principles and spirit of the invention.

The invention claimed is:

1. A method for soothing an infant using a mechanical motion, comprising:

providing a frame, an infant resting member coupled to the frame and a motor that automatically moves the frame and the infant resting member;

securing an infant to the infant resting member in an adjustable position including a position in which the infant's feet are substantially below its head;

securing and positioning the infant on the infant resting member using one or more inflatable elements;

producing, by the motor, a substantially vertical motion of the infant resting member and the infant to soothe the infant; and generating vibrations.

2. The method of claim 1, wherein generating the vibrations further comprises using the motor to generate the vibrations.

3. The method of claim 1, wherein generating the vibrations further comprises using a separate vibration motor to generate the vibrations.

4. The method of claim 1 further comprising adjusting the infant resting member from the infant's feet substantially below its head position to one or more other positions.

5. The method of claim 4, wherein adjusting the infant resting member further comprises adjusting the infant resting member to a horizontal position so that the infant can sleep on the infant resting member.

6. The method of claim 1 further comprising moving the infant resting member and the infant in a resonant vertical motion.

7. The method of claim 1 further comprising moving the infant resting member and the infant in a selectable motion.

8. The method of claim 7, wherein the selectable motion further comprises one or more different motion amplitudes.

* * * * *